US011764474B2

(12) United States Patent
Fan et al.

(10) Patent No.: US 11,764,474 B2
(45) Date of Patent: Sep. 19, 2023

(54) PORTABLE ELECTRONIC DEVICE AND PLATE ANTENNA MODULE THEREOF

(71) Applicant: Taiwan Inpaq electronic Co., Ltd., Miaoli County (TW)

(72) Inventors: Yang-Hsin Fan, Hsinchu County (TW); Ta-Fu Cheng, Miaoli County (TW); Cheng-Yi Wang, New Taipei (TW); Zhi-Xiang Wang, Taoyuan (TW)

(73) Assignee: Taiwan Inpaq electronic Co., Ltd., Miaoli County (TW)

( * ) Notice: Subject to any disclaimer, the term of this patent is extended or adjusted under 35 U.S.C. 154(b) by 58 days.

(21) Appl. No.: 17/672,629

(22) Filed: Feb. 15, 2022

(65) Prior Publication Data

US 2023/0112607 A1 Apr. 13, 2023

(30) Foreign Application Priority Data

Oct. 13, 2021 (TW) ..... 110137880

(51) Int. Cl.
*H01Q 1/24* (2006.01)
*H01Q 9/04* (2006.01)

(52) U.S. Cl.
CPC ..... *H01Q 9/0421* (2013.01); *H01Q 1/243* (2013.01)

(58) Field of Classification Search
CPC ..... H01Q 9/0421; H01Q 1/243
See application file for complete search history.

*Primary Examiner* — Graham P Smith
(74) *Attorney, Agent, or Firm* — Li & Cai Intellectual Property Office

(57) ABSTRACT

A portable electronic device and a plate antenna module thereof are provided. The plate antenna module includes an antenna carrying structure, an inner surrounding radiation structure, a first inner feeding structure, an outer surrounding radiation structure, and a first outer feeding structure. The first inner feeding structure is surrounded by the inner surrounding radiation structure. The inner surrounding radiation structure is surrounded by the outer surrounding radiation structure. The inner surrounding radiation structure and the outer surrounding radiation structure are respectively disposed on two different planes of the antenna carrying structure. The inner surrounding radiation structure and the first inner feeding structure cooperate with each other to form a first antenna assembly for generating a first antenna operating frequency, and the outer surrounding radiation structure and the first outer feeding structure cooperate with each other to form a second antenna assembly for generating a second antenna operating frequency.

10 Claims, 15 Drawing Sheets

PORTABLE ELECTRONIC DEVICE AND PLATE ANTENNA MODULE THEREOF

CROSS-REFERENCE TO RELATED PATENT APPLICATION

This application claims the benefit of priority to Taiwan Patent Application No. 110137880, filed on Oct. 13, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electronic device and an antenna module thereof, and more particularly to a portable electronic device and a plate antenna module thereof.

BACKGROUND OF THE DISCLOSURE

In the related art, a stacked antenna structure can serve as a plate antenna, but the stacked antenna structure adopted in the plate antenna still has room for improvement.

SUMMARY OF THE DISCLOSURE

In response to the above-referenced technical inadequacy, the present disclosure provides a portable electronic device and a plate antenna module thereof.

In one aspect, the present disclosure provides a plate antenna module including an antenna carrying structure, an inner surrounding radiation structure, a first inner feeding structure, a second inner feeding structure, an outer surrounding radiation structure, a first outer feeding structure, a second outer feeding structure, and a plurality of grounding structures. The inner surrounding radiation structure is disposed on the antenna carrying structure. The first inner feeding structure is disposed on the antenna carrying structure, and the first inner feeding structure is surrounded by the inner surrounding radiation structure. The second inner feeding structure is disposed on the antenna carrying structure, and the second inner feeding structure is surrounded by the inner surrounding radiation structure and separate from the first inner feeding structure. The outer surrounding radiation structure is disposed on the antenna carrying structure, and the inner surrounding radiation structure is surrounded by the outer surrounding radiation structure and separate from the outer surrounding radiation structure. The first outer feeding structure is disposed on the antenna carrying structure and corresponds to the first inner feeding structure. The second outer feeding structure is disposed on the antenna carrying structure and corresponds to the second inner feeding structure. The grounding structures are surroundingly disposed on the antenna carrying structure. The inner surrounding radiation structure and the outer surrounding radiation structure are respectively disposed on two different planes of the antenna carrying structure. The inner surrounding radiation structure, the first inner feeding structure and the second inner feeding structure cooperate with each other to form a first antenna assembly for generating a first antenna operating frequency, the outer surrounding radiation structure, the first outer feeding structure and the second outer feeding structure cooperate with each other to form a second antenna assembly for generating a second antenna operating frequency, and the first antenna operating frequency of the first antenna assembly is greater than the second antenna operating frequency of the second antenna assembly.

In another aspect, the present disclosure provides a plate antenna module including an antenna carrying structure, an inner surrounding radiation structure, a first inner feeding structure, an outer surrounding radiation structure, and a first outer feeding structure. The inner surrounding radiation structure is disposed on the antenna carrying structure. The first inner feeding structure is disposed on the antenna carrying structure, and the first inner feeding structure is surrounded by the inner surrounding radiation structure. The outer surrounding radiation structure is disposed on the antenna carrying structure, and the inner surrounding radiation structure is surrounded by the outer surrounding radiation structure and separate from the outer surrounding radiation structure. The first outer feeding structure is disposed on the antenna carrying structure and corresponds to the first inner feeding structure. The inner surrounding radiation structure and the outer surrounding radiation structure are respectively disposed on two different planes of the antenna carrying structure. The inner surrounding radiation structure and the first inner feeding structure cooperate with each other to form a first antenna assembly for generating a first antenna operating frequency, the outer surrounding radiation structure and the first outer feeding structure cooperate with each other to form a second antenna assembly for generating a second antenna operating frequency, and the first antenna operating frequency of the first antenna assembly is greater than the second antenna operating frequency of the second antenna assembly.

In yet another aspect, the present disclosure provides a portable electronic device using a plate antenna module. The plate antenna module includes an antenna carrying structure, an inner surrounding radiation structure, a first inner feeding structure, a second inner feeding structure, an outer surrounding radiation structure, a first outer feeding structure, a second outer feeding structure, and a plurality of grounding structures. The inner surrounding radiation structure is disposed on the antenna carrying structure. The first inner feeding structure is disposed on the antenna carrying structure, and the first inner feeding structure is surrounded by the inner surrounding radiation structure. The second inner feeding structure is disposed on the antenna carrying structure, and the second inner feeding structure is surrounded by the inner surrounding radiation structure and separate from the first inner feeding structure. The outer surrounding radiation structure is disposed on the antenna carrying structure, and the inner surrounding radiation structure is surrounded by the outer surrounding radiation structure and separate from the outer surrounding radiation structure. The first outer feeding structure is disposed on the antenna carrying structure and corresponds to the first inner feeding structure. The second outer feeding structure is disposed on the antenna carrying structure and corresponds to the second inner feeding structure. The grounding structures are surroundingly disposed on the antenna carrying structure. The inner surrounding radiation structure and the outer surrounding radiation structure are respectively disposed on two different planes of the antenna carrying structure. The inner surrounding radiation structure, the first inner feeding structure and the second inner feeding structure cooperate with each other to form a first antenna assembly for generating a first antenna operating frequency, the outer surrounding radiation structure, the first outer feeding structure and the second outer feeding structure cooperate with each other to form a second antenna assembly for generating a second antenna operating frequency, and the first antenna operating frequency of the first antenna assembly is greater than the second antenna operating frequency of the second antenna assembly.

Therefore, by virtue of the inner surrounding radiation structure being disposed on the antenna carrying structure, the first inner feeding structure being disposed on the antenna carrying structure, and the first inner feeding structure being surrounded by the inner surrounding radiation structure, the outer surrounding radiation structure being disposed on the antenna carrying structure, and the inner surrounding radiation structure being surrounded by the outer surrounding radiation structure and separate from the outer surrounding radiation structure, the inner surrounding radiation structure and the outer surrounding radiation structure being respectively disposed on two different planes of the antenna carrying structure, and the first outer feeding structure being disposed on the antenna carrying structure and corresponding to the first inner feeding structure, the inner surrounding radiation structure and the first inner feeding structure can cooperate with each other to form a first antenna assembly for generating a first antenna operating frequency, the outer surrounding radiation structure and the first outer feeding structure can cooperate with each other to form a second antenna assembly for generating a second antenna operating frequency, and the first antenna operating frequency of the first antenna assembly is greater than the second antenna operating frequency of the second antenna assembly.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
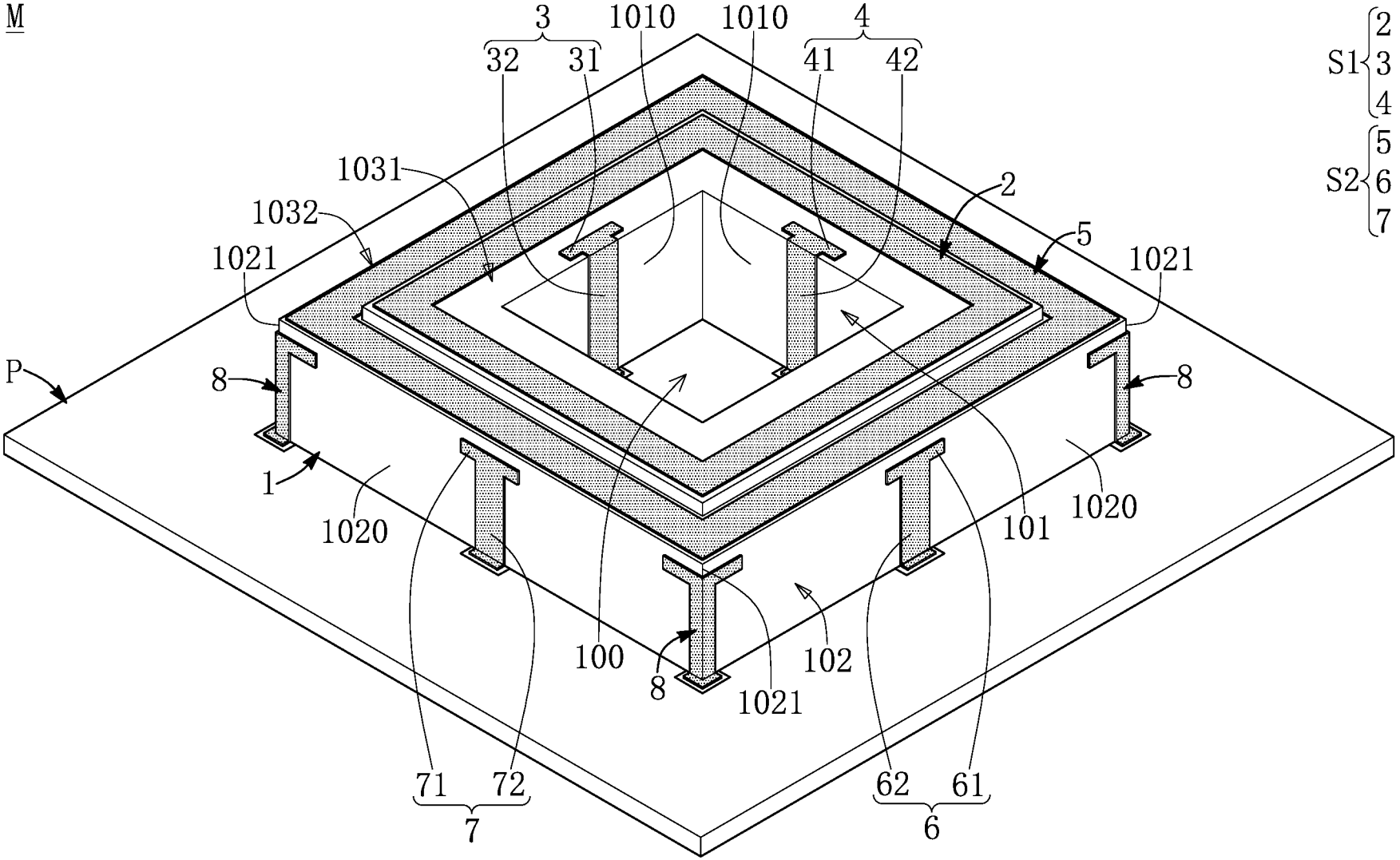
FIG. 1 is a schematic perspective view of a plate antenna module according to a first embodiment of the present disclosure.
Figure 2:
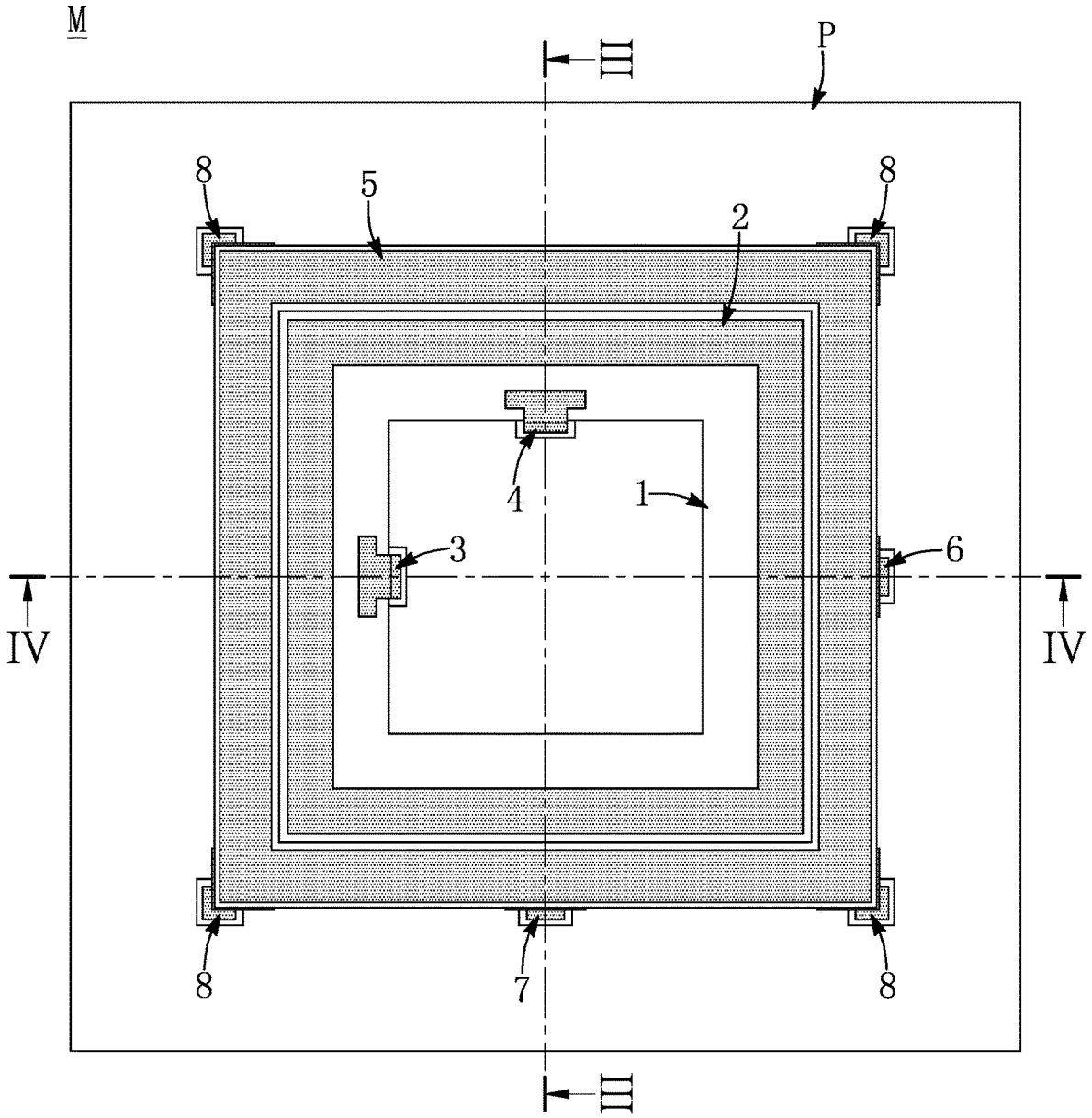
FIG. 2 is a schematic top view of the plate antenna module according to the first embodiment of the present disclosure.
Figure 3:
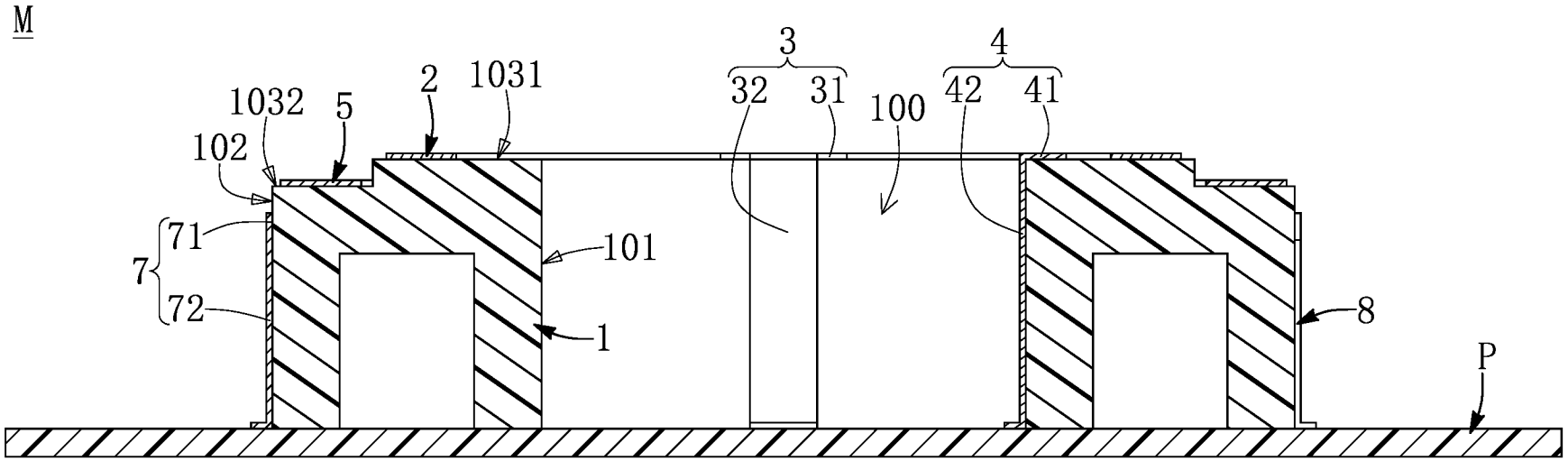
FIG. 3 is a schematic cross-sectional view taken along line III-III of FIG. 2.
Figure 4:
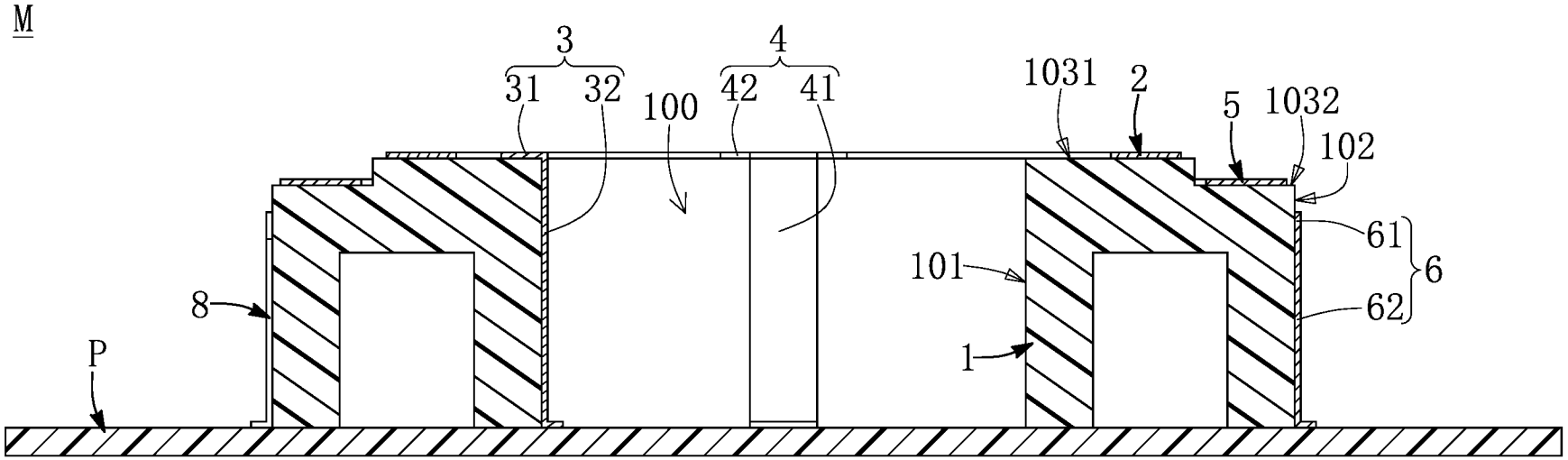
FIG. 4 is a schematic cross-sectional view taken along line IV-IV of FIG. 2.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 15, the present disclosure provides a plate antenna module M (or a patch antenna module) including an antenna carrying structure 1, an inner surrounding radiation structure 2, a first inner feeding structure 3, an outer surrounding radiation structure 5, and a first outer feeding structure 6. More particularly, the inner surrounding radiation structure 2 is disposed on the antenna carrying structure 1. The first inner feeding structure 3 is disposed on the antenna carrying structure 1, and the first inner feeding structure 3 is surrounded by the inner surrounding radiation structure 2. The outer surrounding radiation structure 5 is disposed on the antenna carrying structure 1, and the inner surrounding radiation structure 2 is surrounded by the outer surrounding radiation structure 5 and separate from the outer surrounding radiation structure 5. The first outer feeding structure 6 is disposed on the antenna carrying structure 1 and corresponds to the first inner feeding structure 3. The inner surrounding radiation structure 2 and the outer surrounding radiation structure 5 are respectively disposed on two different planes (such as two different surfaces having two different heights, respectively) of the antenna carrying structure 1. Therefore, the inner surrounding radiation structure 2 and the first inner feeding structure 3 can cooperate with each other to form a first antenna assembly S1 for generating a first antenna operating frequency (or for applying to a first working frequency band), and the outer surrounding radiation structure 5 and the first outer feeding structure 6 can cooperate with each other to form a second antenna assembly S2 for generating a second antenna operating frequency (or for applying to a second working frequency band). In addition, the first antenna operating frequency of the first antenna assembly S1 can be greater than the second antenna operating frequency of the second antenna assembly S2. Moreover, the present disclosure further provides a portable electronic device D, and the portable electronic device D can use the plate antenna module M.

First Embodiment

Referring to FIG. 1 to FIG. 5, a first embodiment of the present disclosure provides a plate antenna module M including an antenna carrying structure 1, an inner surrounding radiation structure 2, a first inner feeding structure 3, a second inner feeding structure 4, an outer surrounding radiation structure 5, a first outer feeding structure 6, a second outer feeding structure 7, and a plurality of grounding structures 8. For example, the plate antenna module M can be disposed on a circuit substrate P including a plurality of conductive pads (not labeled), and the plate antenna module M can serve as a dual-band circularly-polarized plate antenna or a plurality of single-polarization plate antennas. However, the aforementioned details are disclosed for exemplary purposes only, and are not meant to limit the scope of the present disclosure.

More particularly, referring to FIG. 1 to FIG. 4, the inner surrounding radiation structure 2 is disposed on the antenna carrying structure 1. In addition, the outer surrounding radiation structure 5 is disposed on the antenna carrying structure 1, and the inner surrounding radiation structure 2 is surrounded by the outer surrounding radiation structure 5 and separate from the outer surrounding radiation structure 5, so that a surrounding slot (not labeled) can be formed between the inner surrounding radiation structure 2 and the outer surrounding radiation structure 5. For example, the antenna carrying structure 1 can be a plastic substrate, a ceramic substrate, or any carrying substrate for carrying antenna layouts. In addition, the antenna carrying structure 1 can be a hollow carrying structure (or a surrounding carrying structure) having a through space 100, and the antenna carrying structure 1 has an inner surrounding surface 101 inside the through space 100, an outer surrounding surface 102 surrounding the inner surrounding surface 101, a first top surface 1031 connected to the inner surrounding surface 101, and a second top surface 1032 disposed between the first top surface 1031 and the outer surrounding surface 102 (or connected to the outer surrounding surface 102). Furthermore, the first top surface 1031 and the second top surface 1032 of the antenna carrying structure 1 have a height difference between the first top surface 1031 and the second top surface 1032, and the height of the first top surface 1031 relative to the circuit substrate P is greater than the height of the second top surface 1032 relative to the circuit substrate P. Moreover, the inner surrounding radiation structure 2 and the outer surrounding radiation structure 5 are respectively disposed on the first top surface 1031 and the second top surface 1032 of the antenna carrying structure 1 (that is to say, the inner surrounding radiation structure 2 and the outer surrounding radiation structure 5 can be respectively and non-coplanarly disposed on the first top surface 1031 and the second top surface 1032 of the antenna carrying structure 1), so that the height of the first top surface 1031 relative to the circuit substrate P is greater than the height of the second top surface 1032 relative to the circuit substrate P. Furthermore, the surrounding slot can be formed on the top surface 103 of the antenna carrying structure 1, or recessed from the top surface 103 of the antenna carrying structure 1. It should be noted that when the antenna carrying structure 1 serves as a ceramic substrate, the grounding structures 8 can be omitted in the present disclosure. However, the aforementioned details are disclosed for exemplary purposes only, and are not meant to limit the scope of the present disclosure.

Moreover, referring to FIG. 1 to FIG. 4, the first inner feeding structure 3 is disposed on the antenna carrying structure 1, and the first inner feeding structure 3 is surrounded by the inner surrounding radiation structure 2. In addition, the second inner feeding structure 4 is disposed on the antenna carrying structure 1, and the second inner feeding structure 4 is surrounded by the inner surrounding radiation structure 2 and separated from (or adjacent to) the first inner feeding structure 3. For example, the first inner feeding structure 3 includes a first inner horizontal extending portion 31 disposed on the top surface 103 of the antenna carrying structure 1, and a first inner vertical extending portion 32 disposed on the inner surrounding surface 101 of the antenna carrying structure 1 (for example, the first inner vertical extending portion 32 is perpendicular to the first inner horizontal extending portion 31), and the second inner feeding structure 4 includes a second inner horizontal extending portion 41 disposed on the top surface 103 of the antenna carrying structure 1, and a second inner vertical extending portion 42 disposed on the inner surrounding surface 101 of the antenna carrying structure 1 (for example, the second inner vertical extending portion 42 is perpendicular to the second inner horizontal extending portion 41). It should be noted that a maximum width of the first inner horizontal extending portion 31 is greater than a width of the first inner vertical extending portion 32, and a maximum width of the second inner horizontal extending portion 41 is greater than a width of the second inner vertical extending portion 42. In addition, the first inner feeding structure 3 further includes a first inner soldering portion (not labeled) electrically contacting one of the conductive pads of the circuit substrate P, and the second inner feeding structure 4 further includes a second inner soldering portion (not labeled) electrically contacting another one of the conductive pads of the circuit substrate P. Moreover, the first inner feeding structure 3 and the second inner feeding structure 4 can be respectively and electrically connected to two different couplers (such as microstrip couplers). However, the aforementioned details are disclosed for exemplary purposes only, and are not meant to limit the scope of the present disclosure.

Furthermore, referring to FIG. 1 to FIG. 4, the first outer feeding structure 6 is disposed on the antenna carrying structure 1 and corresponds to the first inner feeding structure 3, and the second outer feeding structure 7 is disposed on the antenna carrying structure 1 and corresponds to the second inner feeding structure 4. In addition, the first outer feeding structure 6 and the second outer feeding structure 7 are separated from each other (or adjacent to each other), and both the first outer feeding structure 6 and the second outer feeding structure 7 are spaced apart from the outer surrounding radiation structure 5 by a predetermined distance. For example, the first outer feeding structure 6 includes a first outer horizontal extending portion 61 disposed on the outer surrounding surface 102 of the antenna carrying structure 1, and a first outer vertical extending portion 62 disposed on the outer surrounding surface 102 of the antenna carrying structure 1 (for example, the first outer vertical extending portion 62 is perpendicular to the first outer horizontal extending portion 61), and the second outer feeding structure 7 includes a second outer horizontal extending portion 71 disposed on the outer surrounding surface 102 of the antenna carrying structure 1, and a second outer vertical extending portion 72 disposed on the outer surrounding surface 102 of the antenna carrying structure 1 (for example, the second outer vertical extending portion 72 is perpendicular to the second outer horizontal extending portion 71). It should be noted that a width of the first outer horizontal extending portion 61 is greater than a width of the first outer vertical extending portion 62, and a width of the second outer horizontal extending portion 71 is greater than a width of the second outer vertical extending portion 72. In addition, the first outer feeding structure 6 further includes a first outer soldering portion (not labeled) electrically contacting one of the conductive pads of the circuit substrate P, and the second outer feeding structure 7 further includes a second outer soldering portion (not labeled) electrically contacting another one of the conductive pads of the circuit substrate P. Moreover, the first outer feeding structure 6 and the second outer feeding structure 7 can be respectively and electrically connected to two different couplers (such as microstrip couplers). However, the aforementioned details are disclosed for exemplary purposes only, and are not meant to limit the scope of the present disclosure.

In addition, referring to FIG. 1 to FIG. 4, the grounding structures 8 are surroundingly disposed on the antenna carrying structure 1 and separated from each other, and each of the grounding structures 8 is separate from the outer surrounding radiation structure 5 by a predetermined distance. For example, the grounding structures 8 are surroundingly disposed on the outer surrounding surface 102 of the antenna carrying structure 1 so as to surround the first inner feeding structure 3 and the second inner feeding structure 4. It should be noted that each of the grounding structures 8 includes a grounding soldering portion (not labeled) electrically connected to a corresponding one of the conductive pads of the circuit substrate P. However, the aforementioned details are disclosed for exemplary purposes only, and are not meant to limit the scope of the present disclosure.

For example, referring to FIG. 1 to FIG. 4, the inner surrounding surface 101 of the antenna carrying structure 1 has four inner lateral surfaces 1010, and the outer surrounding surface 102 of the antenna carrying structure 1 has four outer lateral surfaces 1020 and four corner edges 1021. Moreover, the first inner vertical extending portion 32 of the first inner feeding structure 3 and the second inner vertical extending portion 42 of the second inner feeding structure 4 can be respectively disposed on two adjacent ones of the four inner lateral surfaces 1010 of the inner surrounding surface 101. In addition, the first outer feeding structure 6 and the second outer feeding structure 7 can be respectively disposed on two adjacent ones of the four outer lateral surfaces 1020 of the outer surrounding surface 102. Furthermore, a quantity of the grounding structures 8 is four, and the four grounding structures 8 can be respectively disposed on the four corner edges 1021 of the outer surrounding surface 102. However, the aforementioned details are disclosed for exemplary purposes only, and are not meant to limit the scope of the present disclosure.

For example, in another embodiment, the antenna carrying structure 1 may include an inner surrounding substrate (not labeled) having the first top surface 1031, and an outer surrounding substrate (not labeled) having the second top surface 1032, the inner surrounding substrate can be surrounded by the outer surrounding substrate, and the dielectric coefficient of the inner surrounding substrate and the dielectric coefficient of the outer surrounding substrate are different. However, the aforementioned details are disclosed for exemplary purposes only, and are not meant to limit the scope of the present disclosure.

Therefore, a first antenna assembly S1 for generating a first antenna operating frequency can be formed at least by cooperation of the inner surrounding radiation structure 2, the first inner feeding structure 3 and the second inner feeding structure 4 (that can be omitted), a second antenna assembly S2 for generating a second antenna operating frequency can be formed at least by cooperation of the outer surrounding radiation structure 5, the first outer feeding structure 6 and the second outer feeding structure 7 (that can be omitted), and the first antenna operating frequency of the first antenna assembly S1 can be greater than the second antenna operating frequency of the second antenna assembly S2. Hence, the plate antenna module M provided by the present disclosure has antenna characteristics of high gain and low axial ratio. For example, when the plate antenna module M is applied to a smartphone, the first antenna operating frequency and the second antenna operating frequency are 5 GHz and 2.4 GHz, respectively. When the plate antenna module M is applied to a global positioning system (GPS) receiver, the first antenna operating frequency and the second antenna operating frequency are 1.575 GHz and 1.227 GHz, respectively. However, the aforementioned details are disclosed for exemplary purposes only, and are not meant to limit the scope of the present disclosure.

Figure 5:
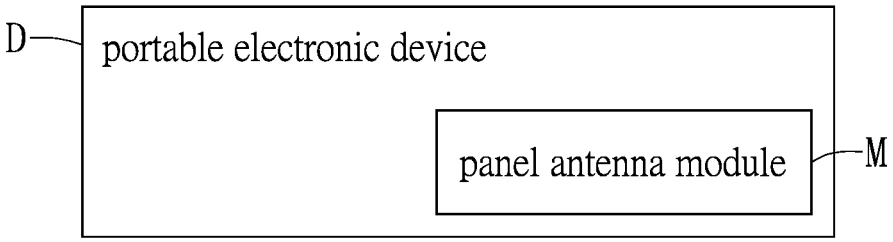
FIG. 5 is a functional block diagram of a portable electronic device using the plate antenna module according to the first embodiment of the present disclosure.
Figure 6:
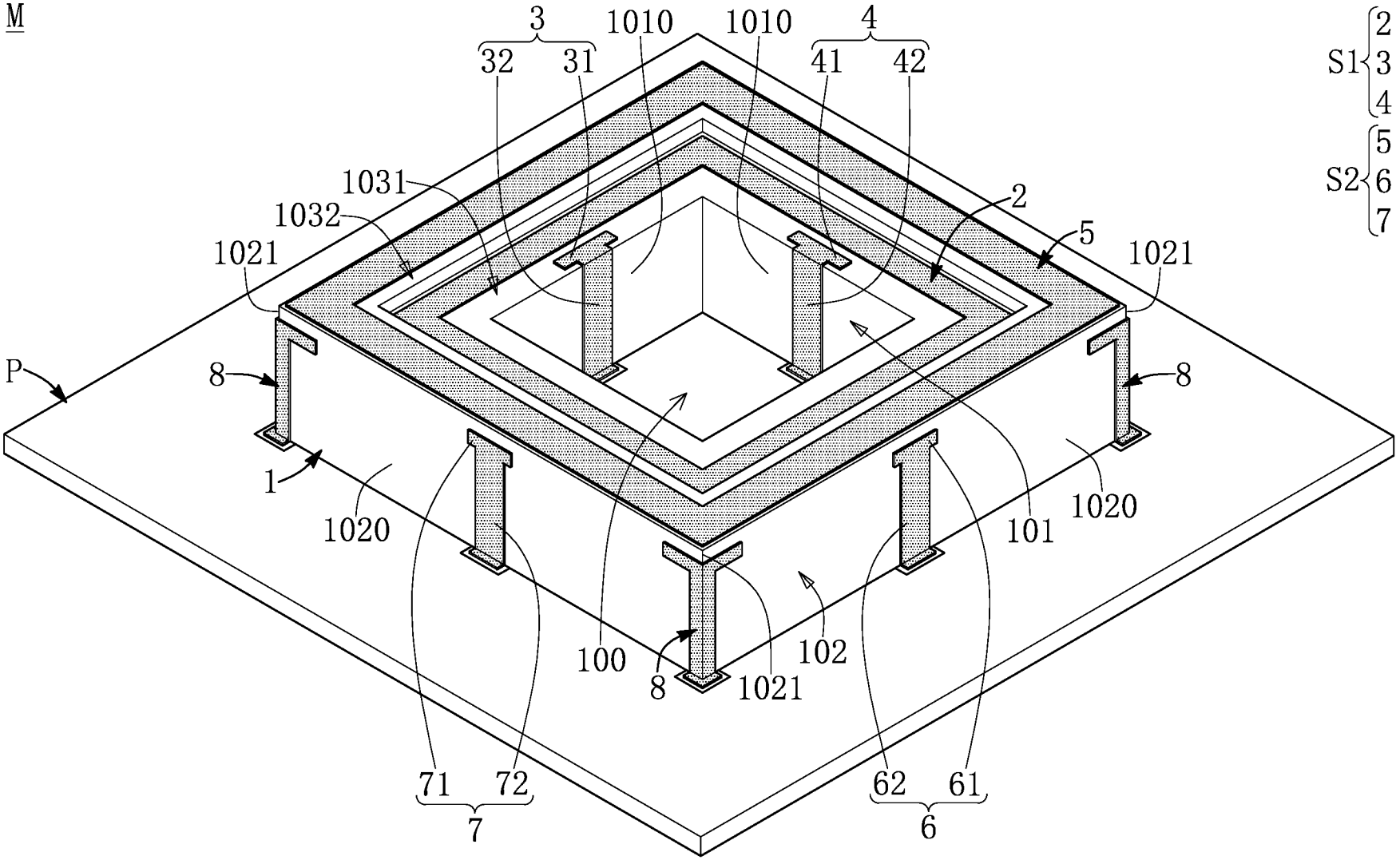
FIG. 6 is a schematic perspective view of a plate antenna module according to a second embodiment of the present disclosure.
Figure 7:
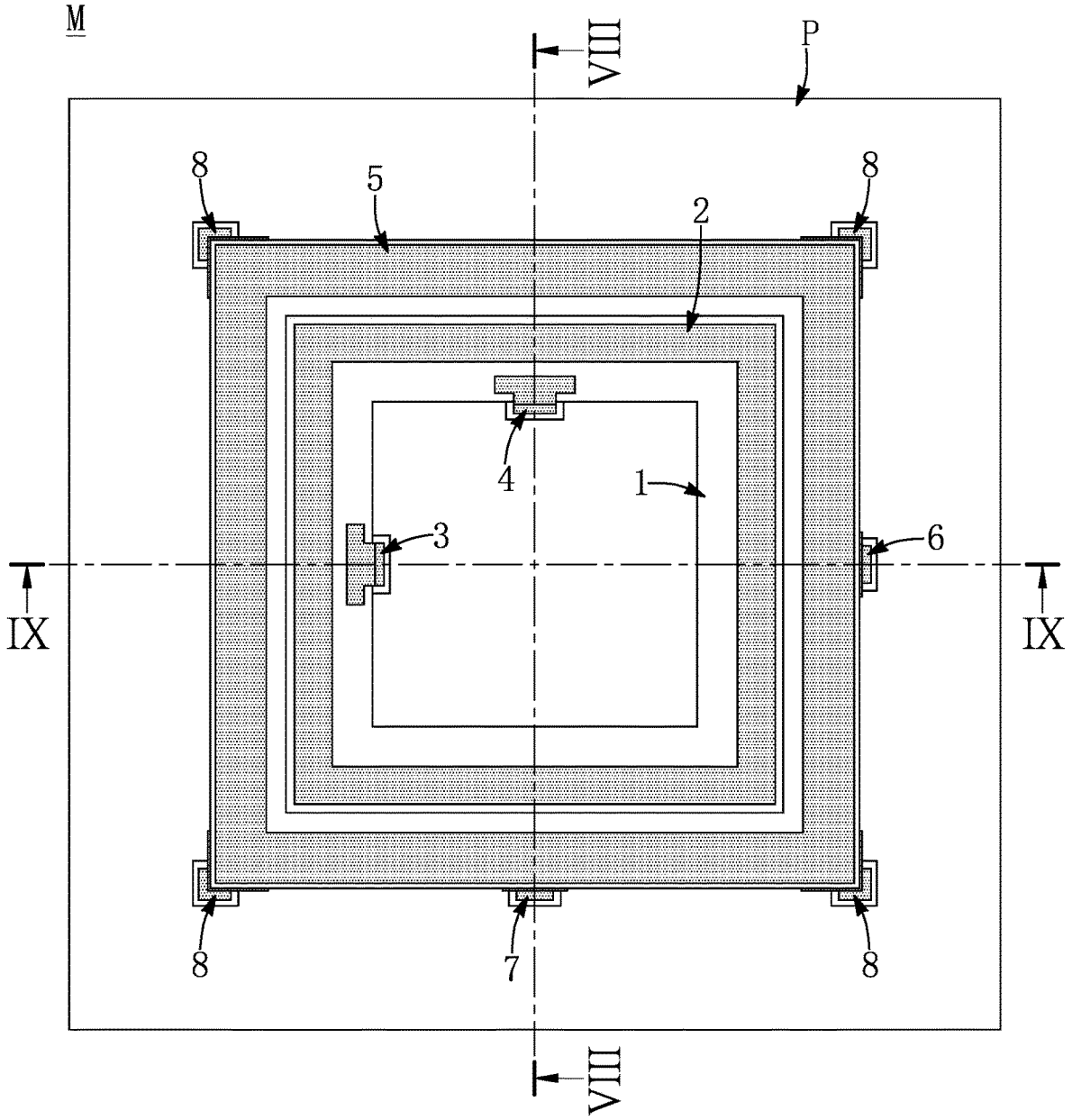
FIG. 7 is a schematic top view of the plate antenna module according to the second embodiment of the present disclosure.
Figure 8:
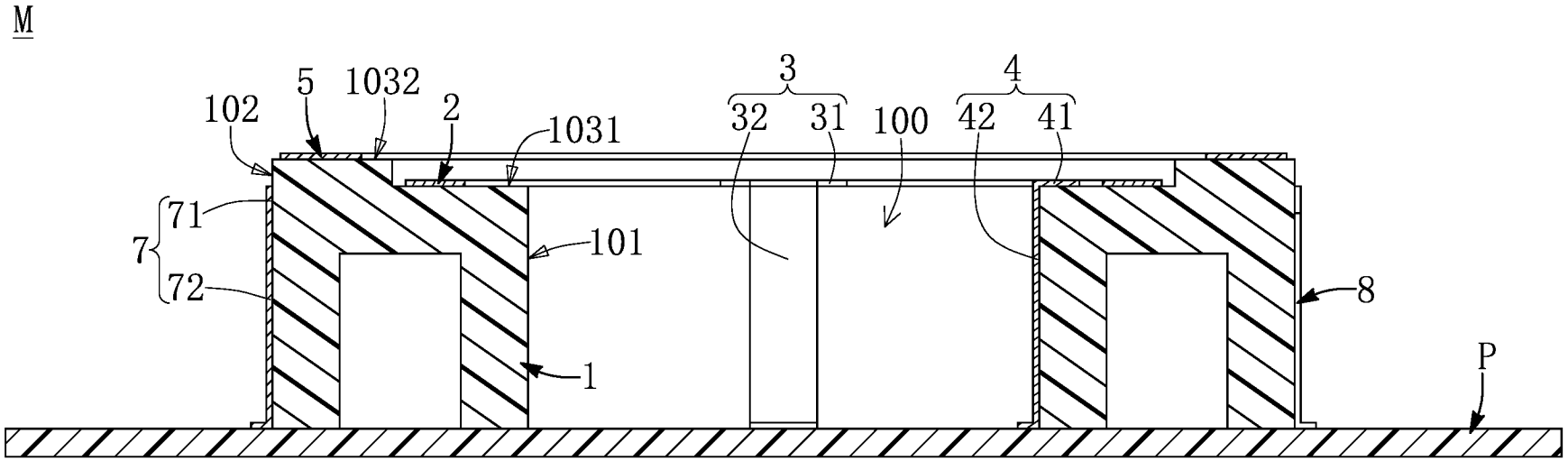
FIG. 8 is a schematic cross-sectional view taken along line VIII-VIII of FIG. 7.
Figure 9:
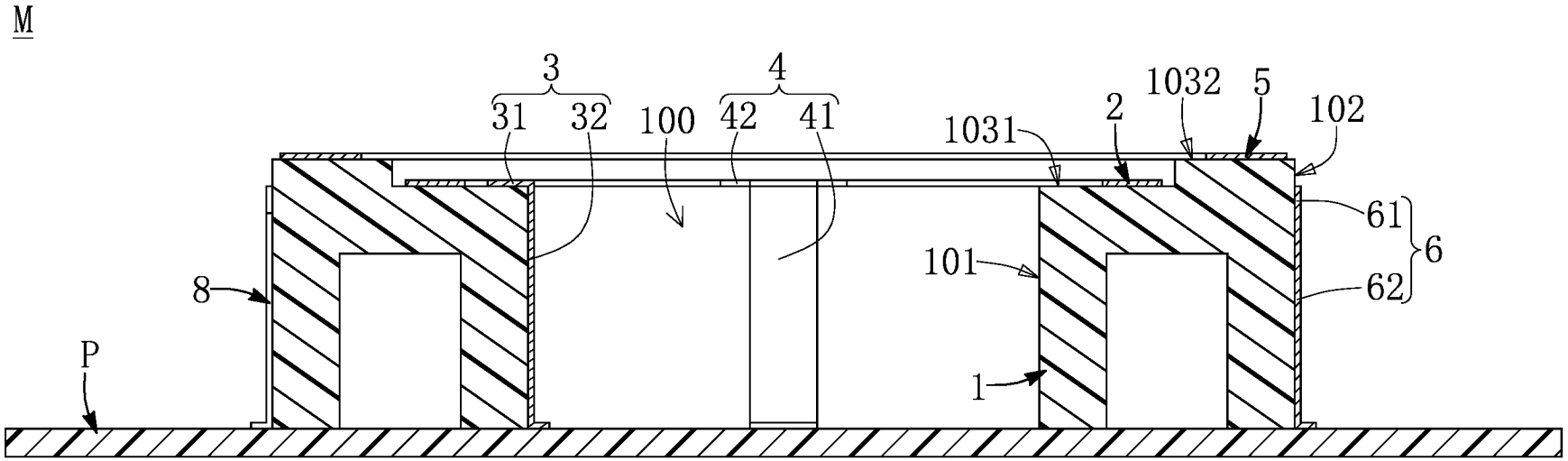
FIG. 9 is a schematic cross-sectional view taken along line IX-IX of FIG. 7.

It should be noted that referring to FIG. 1 and FIG. 5, the first embodiment of the present disclosure further provides a portable electronic device D, and the portable electronic device D can use a plate antenna module M. In addition, the plate antenna module M includes an antenna carrying structure 1, an inner surrounding radiation structure 2, a first inner feeding structure 3, a second inner feeding structure 4 (that can be omitted), an outer surrounding radiation structure 5, a first outer feeding structure 6, a second outer feeding structure 7 (that can be omitted), and a plurality of grounding structures 8. For example, the portable electronic device D can be a laptop computer, a tablet computer, a smartphone, or a GPS receiver. However, the aforementioned details are disclosed for exemplary purposes only, and are not meant to limit the scope of the present disclosure.

Second Embodiment

Referring to FIG. 6 to FIG. 9, a second embodiment of the present disclosure provides a plate antenna module M including an antenna carrying structure 1, an inner surrounding radiation structure 2, a first inner feeding structure 3, a second inner feeding structure 4, an outer surrounding radiation structure 5, a first outer feeding structure 6, a second outer feeding structure 7, and a plurality of grounding structures 8. Comparing FIGS. 6 to 9 with FIGS. 1 to 4 respectively, the main difference between the second embodiment and the first embodiment is as follows: in the second embodiment, the height of the first top surface 1031 relative to the circuit substrate P is smaller than the height of the second top surface 1032 relative to the circuit substrate P. Therefore, the inner surrounding radiation structure 2 and the outer surrounding radiation structure 5 are respectively disposed on the first top surface 1031 and the second top surface 1032 of the antenna carrying structure 1 (that is to say, the inner surrounding radiation structure 2 and the outer surrounding radiation structure 5 can be respectively and non-coplanarly disposed on the first top surface 1031 and the second top surface 1032 of the antenna carrying structure 1), so that the height of the first top surface 1031 relative to the circuit substrate P is smaller than the height of the second top surface 1032 relative to the circuit substrate P.

Third Embodiment

Figure 10:
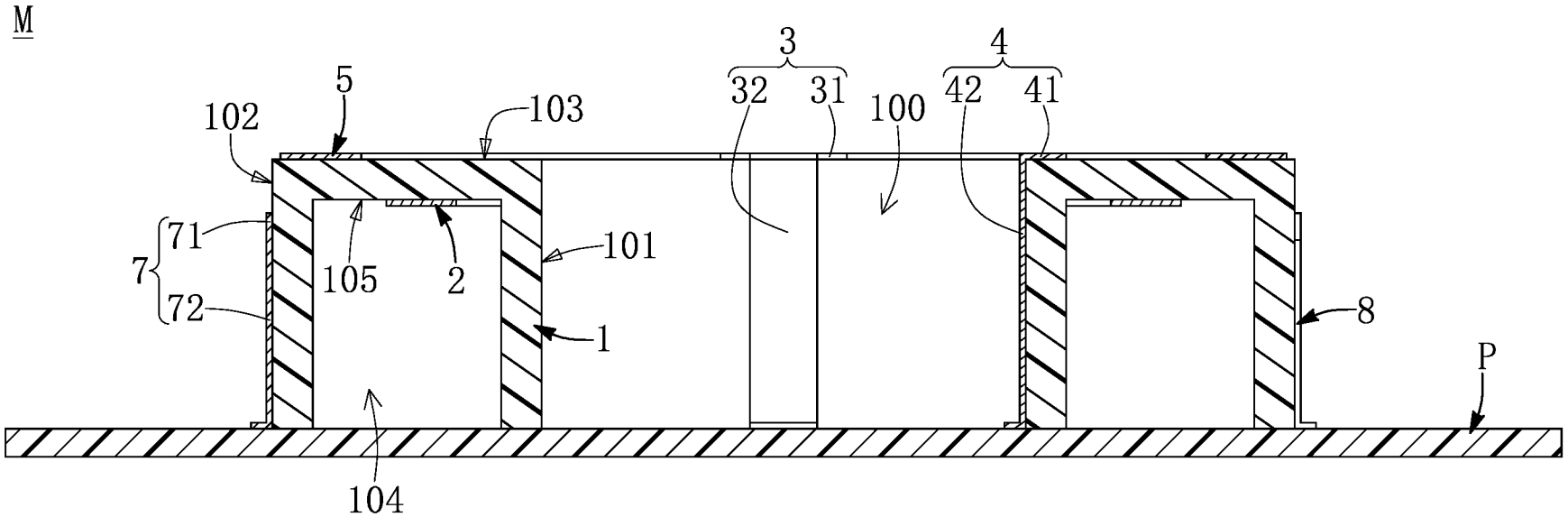
FIG. 10 is a schematic cross-sectional view of a plate antenna module according to a third embodiment of the present disclosure.
Figure 11:
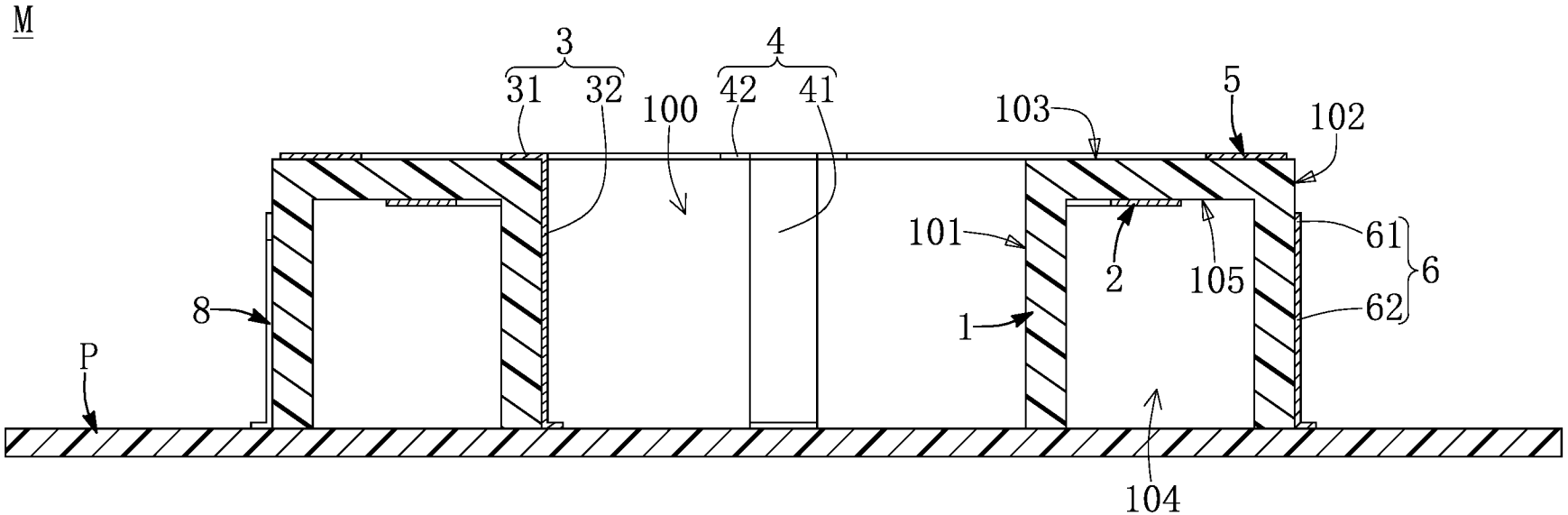
FIG. 11 is another schematic cross-sectional view of the plate antenna module according to the third embodiment of the present disclosure.

Referring to FIG. 10 and FIG. 11, a third embodiment of the present disclosure provides a plate antenna module M including an antenna carrying structure 1, an inner surrounding radiation structure 2, a first inner feeding structure 3, a second inner feeding structure 4, an outer surrounding radiation structure 5, a first outer feeding structure 6, a second outer feeding structure 7, and a plurality of grounding structures 8. Comparing FIG. 10 with FIG. 3, and comparing FIG. 11 with FIG. 4, the main difference between the third embodiment and the first embodiment is as follows: in the third embodiment, the antenna carrying structure 1 has an inner surrounding surface 101 inside the through space 100, an outer surrounding surface 102 surrounding the inner surrounding surface 101, a top surface 103 connected between the inner surrounding surface 101 and the outer surrounding surface 102, a surrounding space 104 formed between the inner surrounding surface 101 and the outer surrounding surface 102, and a bottom surface 105 disposed inside the surrounding space 104 and corresponding to the top surface 103. In addition, the inner surrounding radiation structure 2 is disposed on the bottom surface 105 of the antenna carrying structure 1, and the outer surrounding radiation structure 5 is disposed on the top surface 103 of the antenna carrying structure 1. That is to say, the inner surrounding radiation structure 2 and the outer surrounding radiation structure 5 can be non-coplanarly disposed on the antenna carrying structure 1. It should be noted that the height difference between the inner surrounding radiation structure 2 and the outer surrounding radiation structure 5 can be determined by a thickness (that is a distance from the top surface 103 to the bottom surface 105) of the antenna carrying structure 1.

Fourth Embodiment

Figure 12:
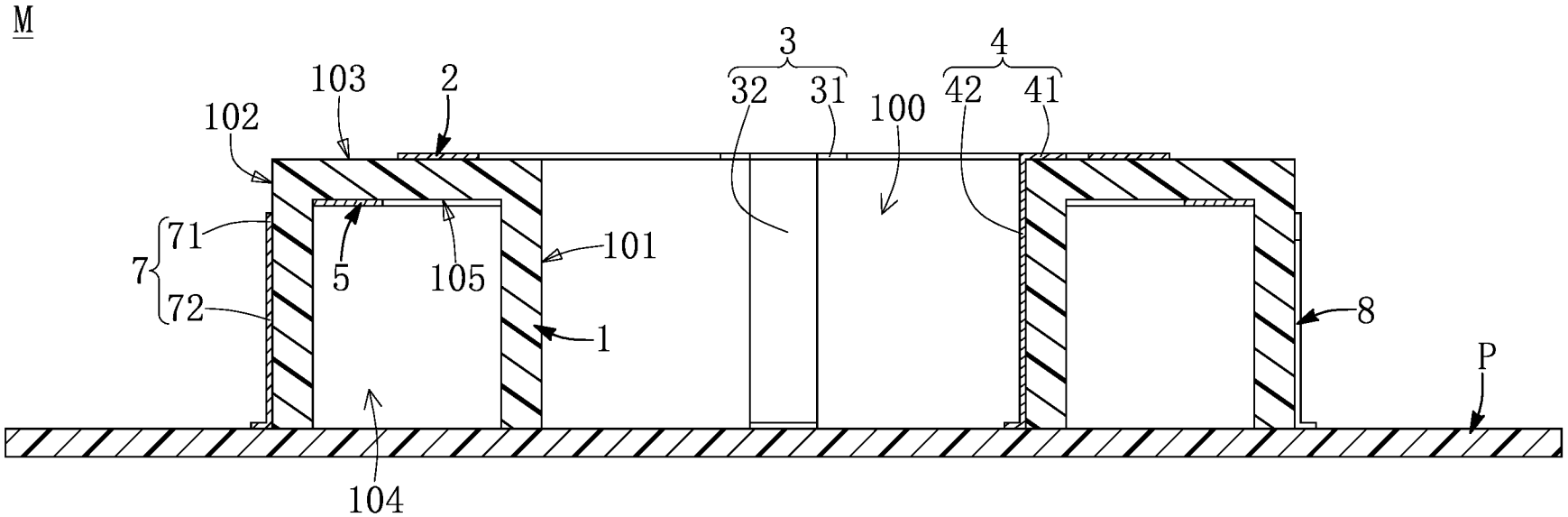
FIG. 12 is a schematic cross-sectional view of a plate antenna module according to a fourth embodiment of the present disclosure.
Figure 13:
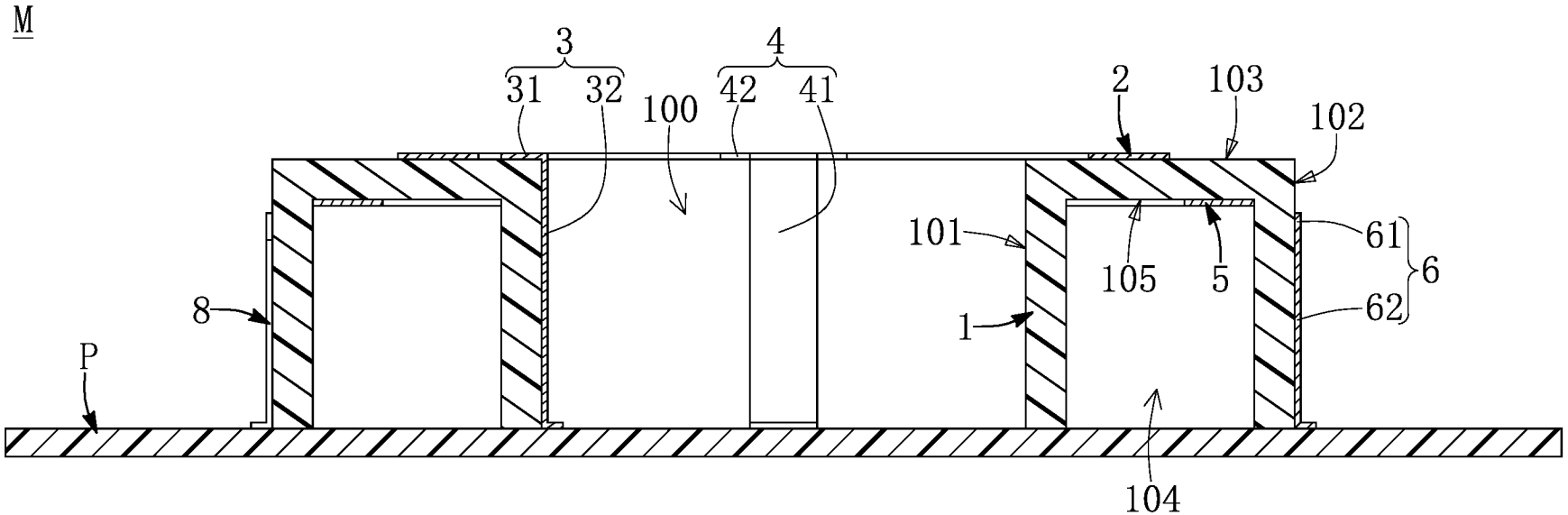
FIG. 13 is another schematic cross-sectional view of the plate antenna module according to the fourth embodiment of the present disclosure.

Referring to FIG. 12 and FIG. 13, a fourth embodiment of the present disclosure provides a plate antenna module M including an antenna carrying structure 1, an inner surrounding radiation structure 2, a first inner feeding structure 3, a second inner feeding structure 4, an outer surrounding radiation structure 5, a first outer feeding structure 6, a second outer feeding structure 7, and a plurality of grounding structures 8. Comparing FIG. 12 with FIG. 3, and comparing FIG. 13 with FIG. 4, the main difference between the fourth embodiment and the first embodiment is as follows: in the fourth embodiment, the antenna carrying structure 1 has an inner surrounding surface 101 inside the through space 100, an outer surrounding surface 102 surrounding the inner surrounding surface 101, a top surface 103 connected between the inner surrounding surface 101 and the outer surrounding surface 102, a surrounding space 104 formed between the inner surrounding surface 101 and the outer surrounding surface 102, and a bottom surface 105 disposed inside the surrounding space 104 and corresponding to the top surface 103. In addition, the inner surrounding radiation structure 2 is disposed on the top surface 103 of the antenna carrying structure 1, and the outer surrounding radiation structure 5 is disposed on the bottom surface 105 of the antenna carrying structure 1. That is to say, the inner surrounding radiation structure 2 and the outer surrounding radiation structure 5 can be coplanarly disposed on the bottom surface 105 of the antenna carrying structure 1. It should be noted that the height difference between the inner surrounding radiation structure 2 and the outer surrounding radiation structure 5 can be determined by a thickness (that is a distance from the top surface 103 to the bottom surface 105) of the antenna carrying structure 1.

For example, in another embodiment, the antenna carrying structure 1 has a first bottom surface (not labeled) and a second bottom surface (not labeled), and the first bottom surface and the second bottom surface of the antenna carrying structure 1 have a height difference. Hence, when the inner surrounding radiation structure 2 and the outer surrounding radiation structure 5 are respectively disposed on the first bottom surface and the second bottom surface of the antenna carrying structure 1, the inner surrounding radiation structure 2 and the outer surrounding radiation structure 5 can be respectively and non-coplanarly disposed on the first bottom surface and the second bottom surface of the antenna carrying structure 1. However, the aforementioned details are disclosed for exemplary purposes only, and are not meant to limit the scope of the present disclosure.

Fifth Embodiment

Figure 14:
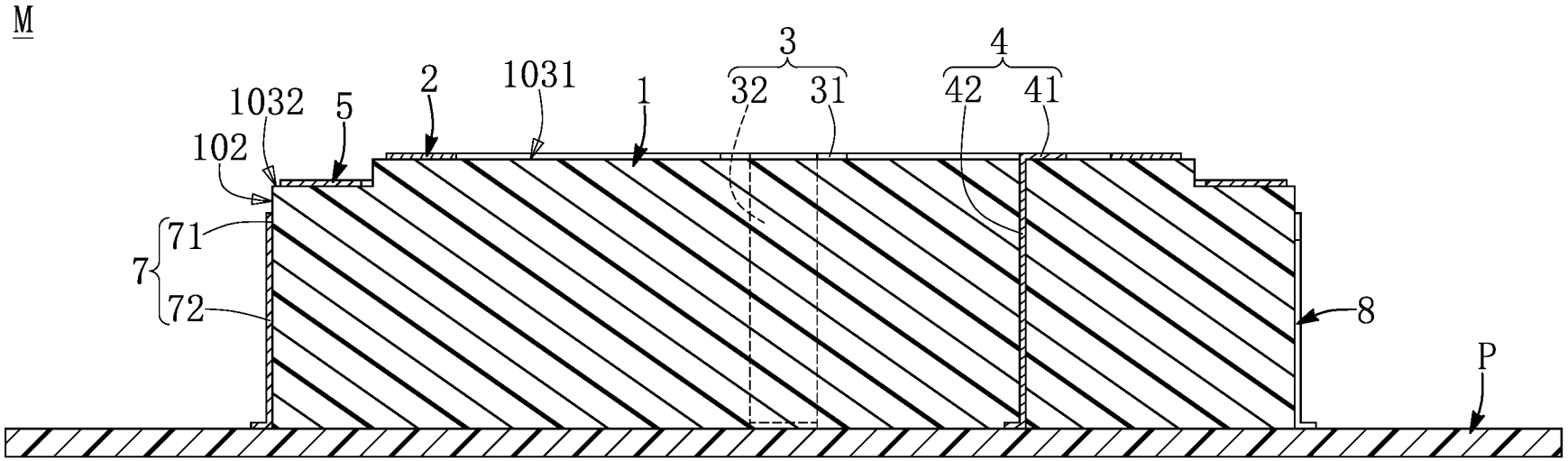
FIG. 14 is a schematic cross-sectional view of a plate antenna module according to a fifth embodiment of the present disclosure.
Figure 15:
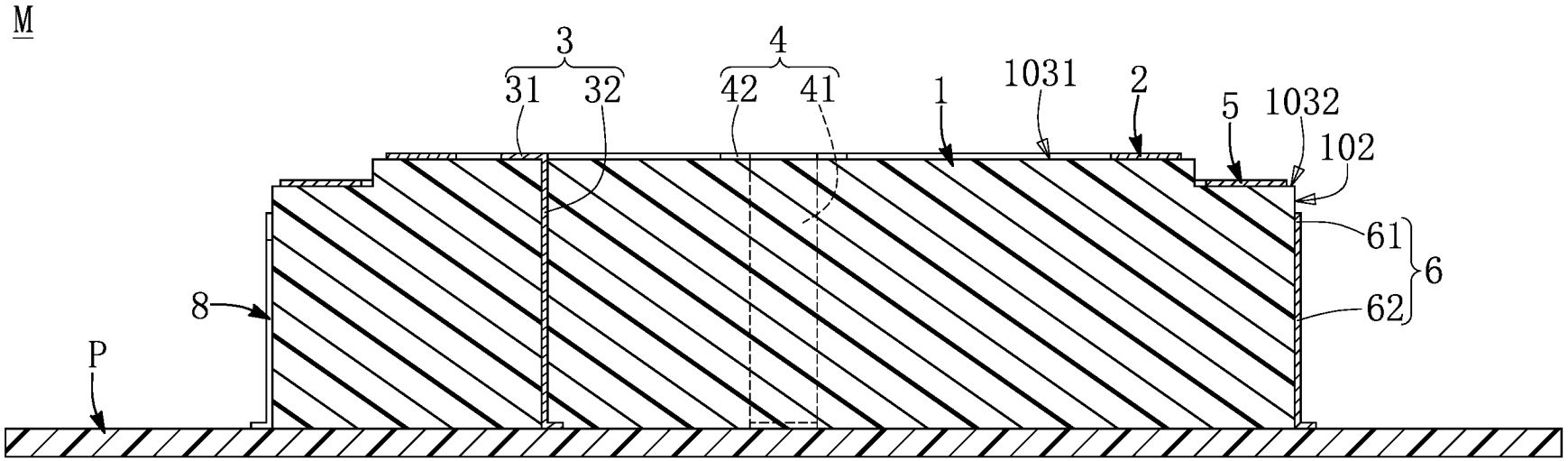
FIG. 15 is another schematic cross-sectional view of the plate antenna module according to the fifth embodiment of the present disclosure.

Referring to FIG. 14 and FIG. 15, a fifth embodiment of the present disclosure provides a plate antenna module M including an antenna carrying structure 1, an inner surrounding radiation structure 2, a first inner feeding structure 3, a second inner feeding structure 4, an outer surrounding radiation structure 5, a first outer feeding structure 6, a second outer feeding structure 7, and a plurality of grounding structures 8. Comparing FIG. 14 with FIG. 3, and comparing FIG. 15 with FIG. 4, the main difference between the fifth embodiment and the first embodiment is as follows: in the fifth embodiment, the antenna carrying structure 1 can be a solid carrying structure without a through space, and the antenna carrying structure 1 has an outer surrounding surface 102, a first top surface 1031, and a second top surface 1032 disposed between the first top surface 1031 and the outer surrounding surface 102 (or connected to the outer surrounding surface 102), and the first top surface 1031 and the second top surface 1032 of the antenna carrying structure 1 have a height difference. Furthermore, the inner surrounding radiation structure 2 and the outer surrounding radiation structure 5 are respectively disposed on the first top surface 1031 and the second top surface 1032 of the antenna carrying structure 1, and the height of the first top surface 1031 relative to the circuit substrate P is greater than the height of the second top surface 1032 relative to the circuit substrate P (that is to say, the inner surrounding radiation structure 2 and the outer surrounding radiation structure 5 can be respectively and non-coplanarly disposed on the first top surface 1031 and the second top surface 1032 of the antenna carrying structure 1, so that the height of the first top surface 1031 relative to the circuit substrate P is greater than the height of the second top surface 1032 relative to the circuit substrate P). More particularly, the first inner feeding structure 3 includes a first inner horizontal extending portion 31 disposed on the top surface 103 of the antenna carrying structure 1, and a first inner vertical extending portion 32 passing through the antenna carrying structure 1, and the second inner feeding structure 4 includes a second inner horizontal extending portion 41 disposed on the top surface 103 of the antenna carrying structure 1, and a second inner vertical extending portion 42 passing through the antenna carrying structure 1.

For example, in another embodiment, the height of the first top surface 1031 relative to the circuit substrate P is smaller than the height of the second top surface 1032 relative to the circuit substrate P. Therefore, the inner surrounding radiation structure 2 and the outer surrounding radiation structure 5 are respectively disposed on the first top surface 1031 and the second top surface 1032 of the antenna carrying structure 1 (that is to say, the inner surrounding radiation structure 2 and the outer surrounding radiation structure 5 can be respectively and non-coplanarly disposed on the first top surface 1031 and the second top surface 1032 of the antenna carrying structure 1), so that the height of the first top surface 1031 relative to the circuit substrate P is smaller than the height of the second top surface 1032 relative to the circuit substrate P. However, the aforementioned details are disclosed for exemplary purposes only, and are not meant to limit the scope of the present disclosure.

BENEFICIAL EFFECTS OF THE EMBODIMENTS

In conclusion, by virtue of the inner surrounding radiation structure 2 being disposed on the antenna carrying structure 1, the first inner feeding structure 3 being disposed on the antenna carrying structure 1, and the first inner feeding structure 3 being surrounded by the inner surrounding radiation structure 2, the outer surrounding radiation structure 5 being disposed on the antenna carrying structure 1, and the inner surrounding radiation structure 2 being surrounded by the outer surrounding radiation structure 5 and separate from the outer surrounding radiation structure 5, the inner surrounding radiation structure 2 and the outer surrounding radiation structure 5 being respectively disposed on two different planes of the antenna carrying structure 1, and the first outer feeding structure 6 being disposed on the antenna carrying structure 1 and corresponding to the first inner feeding structure 3, the inner surrounding radiation structure 2 and the first inner feeding structure 3 can cooperate with each other to form a first antenna assembly S1 for generating a first antenna operating frequency, the outer surrounding radiation structure 5 and the first outer feeding structure 6 can cooperate with each other to form a second antenna assembly S2 for generating a second antenna operating frequency, and the first antenna operating frequency of the first antenna assembly S1 is greater than the second antenna operating frequency of the second antenna assembly S2.

It should be noted that the plate antenna module M provided by the present disclosure has antenna characteristics of high gain and low axial ratio.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A plate antenna module, comprising:

an antenna carrying structure;

an inner surrounding radiation structure disposed on the antenna carrying structure;

a first inner feeding structure disposed on the antenna carrying structure, wherein the first inner feeding structure is surrounded by the inner surrounding radiation structure;

a second inner feeding structure disposed on the antenna carrying structure, wherein the second inner feeding structure is surrounded by the inner surrounding radiation structure and separate from the first inner feeding structure;

an outer surrounding radiation structure disposed on the antenna carrying structure, wherein the inner surrounding radiation structure is surrounded by the outer surrounding radiation structure and separate from the outer surrounding radiation structure;

a first outer feeding structure disposed on the antenna carrying structure and corresponding to the first inner feeding structure;

a second outer feeding structure disposed on the antenna carrying structure and corresponding to the second inner feeding structure; and a plurality of grounding structures surroundingly disposed on the antenna carrying structure;

wherein the inner surrounding radiation structure and the outer surrounding radiation structure are respectively disposed on two different planes of the antenna carrying structure;

wherein the inner surrounding radiation structure, the first inner feeding structure and the second inner feeding structure cooperate with each other to form a first antenna assembly for generating a first antenna operating frequency, the outer surrounding radiation structure, the first outer feeding structure and the second outer feeding structure cooperate with each other to form a second antenna assembly for generating a second antenna operating frequency, and the first antenna operating frequency of the first antenna assembly is greater than the second antenna operating frequency of the second antenna assembly.

2. The plate antenna module according to claim 1, wherein the antenna carrying structure is a plastic substrate;

wherein the antenna carrying structure is a hollow carrying structure having a through space, the antenna carrying structure has an inner surrounding surface inside the through space, an outer surrounding surface surrounding the inner surrounding surface, a first top surface connected to the inner surrounding surface, and a second top surface disposed between the first top surface and the outer surrounding surface, and the first top surface and the second top surface of the antenna carrying structure have a height difference;

wherein the inner surrounding radiation structure and the outer surrounding radiation structure are respectively disposed on the first top surface and the second top surface of the antenna carrying structure;

wherein the first inner feeding structure includes a first inner horizontal extending portion disposed on the top surface of the antenna carrying structure, and a first inner vertical extending portion disposed on the inner surrounding surface of the antenna carrying structure, and the second inner feeding structure includes a second inner horizontal extending portion disposed on the top surface of the antenna carrying structure, and a second inner vertical extending portion disposed on the inner surrounding surface of the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure;

wherein the inner surrounding surface of the antenna carrying structure has four inner lateral surfaces, and the outer surrounding surface of the antenna carrying structure has four outer lateral surfaces and four corner edges;

wherein the first inner vertical extending portion of the first inner feeding structure and the second inner vertical extending portion of the second inner feeding structure are respectively disposed on two adjacent ones of the four inner lateral surfaces of the inner surrounding surface;

wherein the first outer feeding structure and the second outer feeding structure are respectively disposed on two adjacent ones of the four outer lateral surfaces of the outer surrounding surface;

wherein a quantity of the grounding structures is four, and the four grounding structures are respectively disposed on the four corner edges of the outer surrounding surface.

3. The plate antenna module according to claim 1, wherein the antenna carrying structure is a hollow carrying structure having a through space, and the antenna carrying structure has an inner surrounding surface inside the through space, an outer surrounding surface surrounding the inner surrounding surface, a top surface connected between the inner surrounding surface and the outer surrounding surface, a surrounding space formed between the inner surrounding surface and the outer surrounding surface, and a bottom surface disposed inside the surrounding space and corresponding to the top surface;

wherein the inner surrounding radiation structure is disposed on one of the top surface and the bottom surface of the antenna carrying structure, and the outer surrounding radiation structure is disposed on one of the top surface and the bottom surface of the antenna carrying structure;

wherein the first inner feeding structure includes a first inner horizontal extending portion disposed on the top surface of the antenna carrying structure, and a first inner vertical extending portion disposed on the inner surrounding surface of the antenna carrying structure, and the second inner feeding structure includes a second inner horizontal extending portion disposed on the top surface of the antenna carrying structure, and a second inner vertical extending portion disposed on the inner surrounding surface of the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure.

4. The plate antenna module according to claim 1, wherein the antenna carrying structure is a solid carrying structure without a through space, the antenna carrying structure has an outer surrounding surface, a first top surface, and a second top surface disposed between the first top surface and the outer surrounding surface, and the first top surface and the second top surface of the antenna carrying structure have a height difference;

wherein the inner surrounding radiation structure and the outer surrounding radiation structure are respectively disposed on the first top surface and the second top surface of the antenna carrying structure;

wherein the first inner feeding structure includes a first inner horizontal extending portion disposed on the top surface of the antenna carrying structure, and a first inner vertical extending portion passing through the antenna carrying structure, and the second inner feeding structure includes a second inner horizontal extending portion disposed on the top surface of the antenna carrying structure, and a second inner vertical extending portion passing through the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure.

5. A plate antenna module, comprising:

an antenna carrying structure;

an inner surrounding radiation structure disposed on the antenna carrying structure;

a first inner feeding structure disposed on the antenna carrying structure, wherein the first inner feeding structure is surrounded by the inner surrounding radiation structure;

an outer surrounding radiation structure disposed on the antenna carrying structure, wherein the inner surrounding radiation structure is surrounded by the outer surrounding radiation structure and separate from the outer surrounding radiation structure; and a first outer feeding structure disposed on the antenna carrying structure and corresponding to the first inner feeding structure;

wherein the inner surrounding radiation structure and the outer surrounding radiation structure are respectively disposed on two different planes of the antenna carrying structure;

wherein the inner surrounding radiation structure and the first inner feeding structure cooperate with each other to form a first antenna assembly for generating a first antenna operating frequency, the outer surrounding radiation structure and the first outer feeding structure cooperate with each other to form a second antenna assembly for generating a second antenna operating frequency, and the first antenna operating frequency of the first antenna assembly is greater than the second antenna operating frequency of the second antenna assembly.

6. A portable electronic device using the plate antenna module according to claim 5.

7. A portable electronic device using a plate antenna module, wherein the plate antenna module includes:

an antenna carrying structure;

an inner surrounding radiation structure disposed on the antenna carrying structure;

a first inner feeding structure disposed on the antenna carrying structure, wherein the first inner feeding structure is surrounded by the inner surrounding radiation structure;

a second inner feeding structure disposed on the antenna carrying structure, wherein the second inner feeding structure is surrounded by the inner surrounding radiation structure and separate from the first inner feeding structure;

an outer surrounding radiation structure disposed on the antenna carrying structure, wherein the inner surrounding radiation structure is surrounded by the outer surrounding radiation structure and separate from the outer surrounding radiation structure;

a first outer feeding structure disposed on the antenna carrying structure and corresponding to the first inner feeding structure;

a second outer feeding structure disposed on the antenna carrying structure and corresponding to the second inner feeding structure; and a plurality of grounding structures surroundingly disposed on the antenna carrying structure;

wherein the inner surrounding radiation structure and the outer surrounding radiation structure are respectively disposed on two different planes of the antenna carrying structure;

wherein the inner surrounding radiation structure, the first inner feeding structure and the second inner feeding structure cooperate with each other to form a first antenna assembly for generating a first antenna operating frequency, the outer surrounding radiation structure, the first outer feeding structure and the second outer feeding structure cooperate with each other to form a second antenna assembly for generating a second antenna operating frequency, and the first antenna operating frequency of the first antenna assembly is greater than the second antenna operating frequency of the second antenna assembly.

8. The portable electronic device according to claim 7, wherein the antenna carrying structure is a plastic substrate;

wherein the antenna carrying structure is a hollow carrying structure having a through space, the antenna carrying structure has an inner surrounding surface inside the through space, an outer surrounding surface surrounding the inner surrounding surface, a first top surface connected to the inner surrounding surface, and a second top surface disposed between the first top surface and the outer surrounding surface, and the first top surface and the second top surface of the antenna carrying structure have a height difference;

wherein the inner surrounding radiation structure and the outer surrounding radiation structure are respectively disposed on the first top surface and the second top surface of the antenna carrying structure;

wherein the first inner feeding structure includes a first inner horizontal extending portion disposed on the top surface of the antenna carrying structure, and a first inner vertical extending portion disposed on the inner surrounding surface of the antenna carrying structure, and the second inner feeding structure includes a second inner horizontal extending portion disposed on the top surface of the antenna carrying structure, and a second inner vertical extending portion disposed on the inner surrounding surface of the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure;

wherein the inner surrounding surface of the antenna carrying structure has four inner lateral surfaces, and the outer surrounding surface of the antenna carrying structure has four outer lateral surfaces and four corner edges;

wherein the first inner vertical extending portion of the first inner feeding structure and the second inner vertical extending portion of the second inner feeding structure are respectively disposed on two adjacent ones of the four inner lateral surfaces of the inner surrounding surface;

wherein the first outer feeding structure and the second outer feeding structure are respectively disposed on two adjacent ones of the four outer lateral surfaces of the outer surrounding surface;

wherein a quantity of the grounding structures is four, and the four grounding structures are respectively disposed on the four corner edges of the outer surrounding surface.

9. The portable electronic device according to claim 7, wherein the antenna carrying structure is a hollow carrying structure having a through space, and the antenna carrying structure has an inner surrounding surface inside the through space, an outer surrounding surface surrounding the inner surrounding surface, a top surface connected between the inner surrounding surface and the outer surrounding surface, a surrounding space formed between the inner surrounding surface and the outer surrounding surface, and a bottom surface disposed inside the surrounding space and corresponding to the top surface;

wherein the inner surrounding radiation structure is disposed on one of the top surface and the bottom surface of the antenna carrying structure, and the outer surrounding radiation structure is disposed on one of the top surface and the bottom surface of the antenna carrying structure;

wherein the first inner feeding structure includes a first inner horizontal extending portion disposed on the top surface of the antenna carrying structure, and a first inner vertical extending portion disposed on the inner surrounding surface of the antenna carrying structure, and the second inner feeding structure includes a second inner horizontal extending portion disposed on the top surface of the antenna carrying structure, and a second inner vertical extending portion disposed on the inner surrounding surface of the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure.

10. The portable electronic device according to claim 7, wherein wherein the antenna carrying structure is a solid carrying structure without a through space, the antenna carrying structure has an outer surrounding surface, a first top surface, and a second top surface disposed between the first top surface and the outer surrounding surface, and the first top surface and the second top surface of the antenna carrying structure have a height difference;

wherein the inner surrounding radiation structure and the outer surrounding radiation structure are respectively disposed on the first top surface and the second top surface of the antenna carrying structure;

wherein the first inner feeding structure includes a first inner horizontal extending portion disposed on the top surface of the antenna carrying structure, and a first inner vertical extending portion passing through the antenna carrying structure, and the second inner feeding structure includes a second inner horizontal extending portion disposed on the top surface of the antenna carrying structure, and a second inner vertical extending portion passing through the antenna carrying structure;

wherein the first outer feeding structure includes a first outer horizontal extending portion disposed on the outer surrounding surface of the antenna carrying structure, and a first outer vertical extending portion disposed on the outer surrounding surface of the antenna carrying structure, and the second outer feeding structure includes a second outer horizontal extending portion disposed on the outer surrounding surface of the antenna carrying structure, and a second outer vertical extending portion disposed on the outer surrounding surface of the antenna carrying structure;

wherein the grounding structures are surroundingly disposed on the outer surrounding surface of the antenna carrying structure so as to surround the first inner feeding structure and the second inner feeding structure.

* * * * *